US005441424A

United States Patent [19]

Morlion et al.

[11] Patent Number: 5,441,424

[45] Date of Patent: Aug. 15, 1995

[54] CONNECTOR FOR COAXIAL AND/OR TWINAXIAL CABLES

[75] Inventors: Danny L. Morlion, St-Amandsberg; Luc O. Jonckheere, Dilbeek, both of Belgium

[73] Assignee: Framatome Connectors International, Paris, France

[21] Appl. No.: 225,536

[22] Filed: Apr. 11, 1994

[30] Foreign Application Priority Data

Apr. 15, 1993 [NL] Netherlands ..... 9300641

[51] Int. Cl.[6] ..... H01R 4/24

[52] U.S. Cl. ..... 439/581; 439/578; 439/607

[58] Field of Search ..... 439/497, 513–515, 439/575–580, 675, 607, 610

[56] References Cited

U.S. PATENT DOCUMENTS

| | | | |
|---|---|---|---|
| 3,825,874 | 7/1974 | Peverill | 439/579 |
| 4,453,798 | 6/1984 | Asick et al. . | |
| 4,867,707 | 9/1989 | Widdoes | 439/610 |
| 4,897,046 | 1/1990 | Tengler et al. | 439/610 |
| 5,026,306 | 6/1991 | Uekido et al. | 439/675 |
| 5,057,038 | 10/1991 | Bowen et al. | 439/494 |
| 5,064,390 | 11/1991 | Umesato et al. | 439/579 |
| 5,114,364 | 5/1992 | Hunter | 439/497 |
| 5,241,135 | 8/1993 | Fetzer | 439/579 |
| 5,330,371 | 7/1994 | Andrews | 439/579 |

*Primary Examiner*—Larry I. Schwartz
*Assistant Examiner*—Jill DeMello
*Attorney, Agent, or Firm*—Perman & Green

[57] ABSTRACT

A connector for coaxial and/or twinaxial cables for connecting the cables to regularly arranged signal and ground contact pins comprises a housing of insulating material and female signal and ground contacts regularly arranged in the housing. Further, the connector comprises an outer conductor enclosing at least one signal contact. The female signal and ground contacts are provided with identical parts which can be plugged on the contact pins. The outer conductor encloses at least a signal and a ground contact and the ground contact is connected with the outer conductor.

7 Claims, 2 Drawing Sheets

CONNECTOR FOR COAXIAL AND/OR TWINAXIAL CABLES

BACKGROUND OF THE INVENTION

The invention relates to a connector for coaxial and/or twinaxial cables for connecting the cables to regularly arranged signal and ground contact pins, comprising a housing of insulating material and female signal and ground contacts regularly arranged in the housing and an outer conductor enclosing at least one signal contact.

Such a connector is disclosed for example in U.S. Pat. No. 4,867,707. In this known connector a housing of insulating material is provided for each cable, in which housing one or two signal contacts are provided enclosed by an outer conductor, wherein a special ground contact is attached to the outer conductor. Thereby the manufacturing of the connector is complicated and the connector takes up relatively much room.

SUMMARY OF THE INVENTION

The invention aims to provide an improved connector of the above-mentioned type.

To this end the female signal and ground contacts are provided with identical parts which can be plugged on the contact pins, wherein the outer conductor encloses at least a signal and a ground contact, the ground contact being connected with the outer conductor.

In this manner a connector is obtained, wherein the signal and ground contacts are mainly made in an identical way and wherein the outer conductor consists of a simple metal casing of the housing in which the signal and ground contacts are accommodated.

The connection of each female ground contact with the outer conductor is preferably obtained in that each female ground contact comprises a contact spring element contacting the inner side of the outer conductor.

Preferably the female signal and ground contacts are aligned within the outer conductor.

The invention will be further explained by reference to the drawings in which two embodiments are shown.

DETAILED DESCRIPTION OF THE PREFERRED EMBODIMENTS

Figure 1:
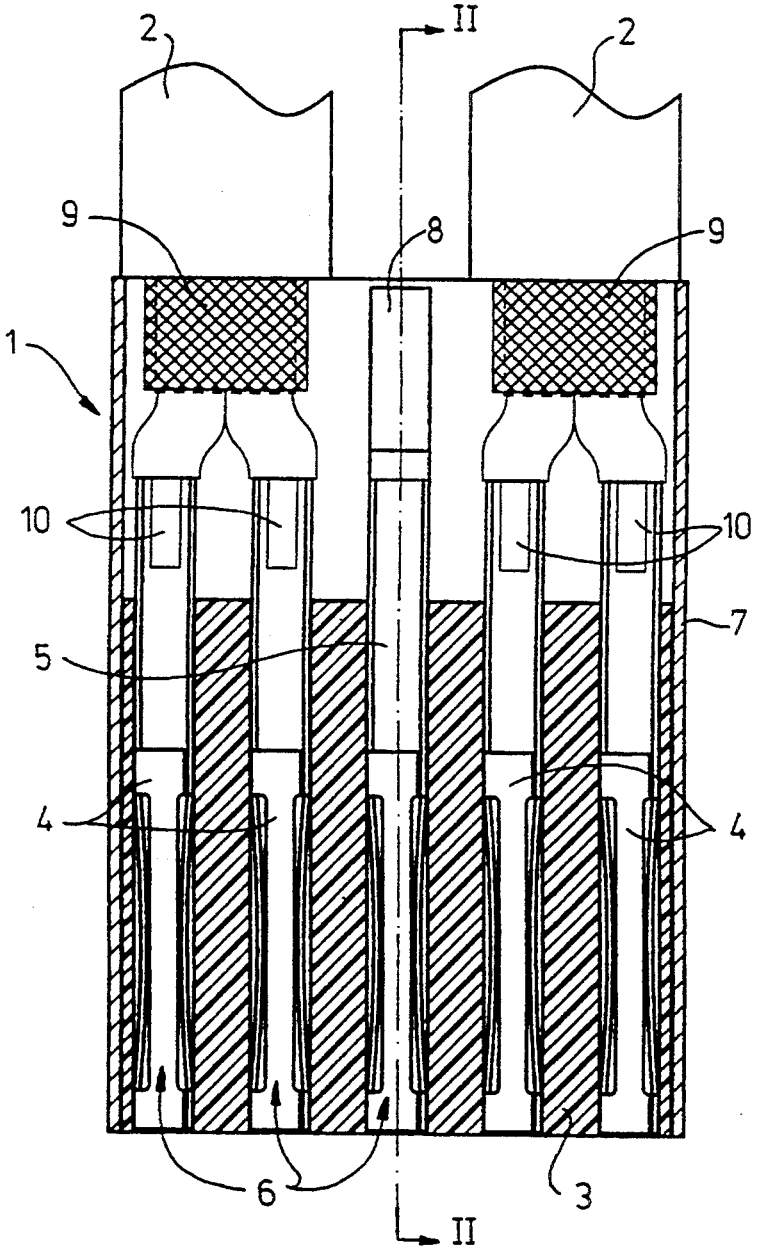
FIG. 1 is a longitudinal section of an embodiment of the connector according to the invention for two twinaxial cables.

FIG. 1 shows a longitudinal section of a connector 1 adapted to connect two twinaxial cables 2 to a printed circuit board not further shown. A connector made in a usual manner is mounted on the printed circuit board and comprises signal and ground contact pins of a usual type regularly arranged in rows and columns.

The connector 1 comprises a housing 3 of insulating material in which four female signal contacts 4 and a female ground contact 5 are provided. The signal and ground contacts 4, 5 are aligned within the housing 3 and as for the portion for contacting the contact pins they are made with mutually identical contact parts 6.

Figure 2:
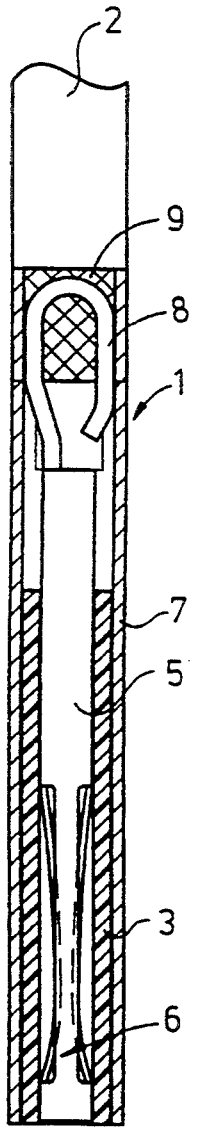
FIG. 2 is a section according to the line II—II in FIG. 1.

The connector 1 further comprises an outer conductor 7 enclosing the housing 3 and thus the signal and ground contacts 4, 5. As shown in FIGS. 1 and 2, the outer conductor 7 has a rectangular cross-section. At the end opposite of the contact part 6 the ground contact 5 comprises a contact spring element 8 contacting the inner side of the outer conductor 7. The outer conductors 9 of the cables 2 are connected to the outer conductor 7 and thereby to the ground contact 5. The inner conductors 10 are connected to the signal contacts 4 in a conventional manner. The ground contact 5 is lying between both pairs of signal contacts 4 of the respective cables 2 so that a separation between the signal conductors of both cables is maintained within the connector 1.

The connector 1 described provides the possibility to connect one differential pair of shielded signal conductors to the printed circuit board per mm at a spacing between the contact pins on the printed circuit board of 2 mm. Thereby a very high contact density is obtained. The connector 1 further shows the advantage that manufacturing of all parts is relatively simple as no special contacts or contact spring elements for providing ground connections have to be manufactured.

Figure 3:
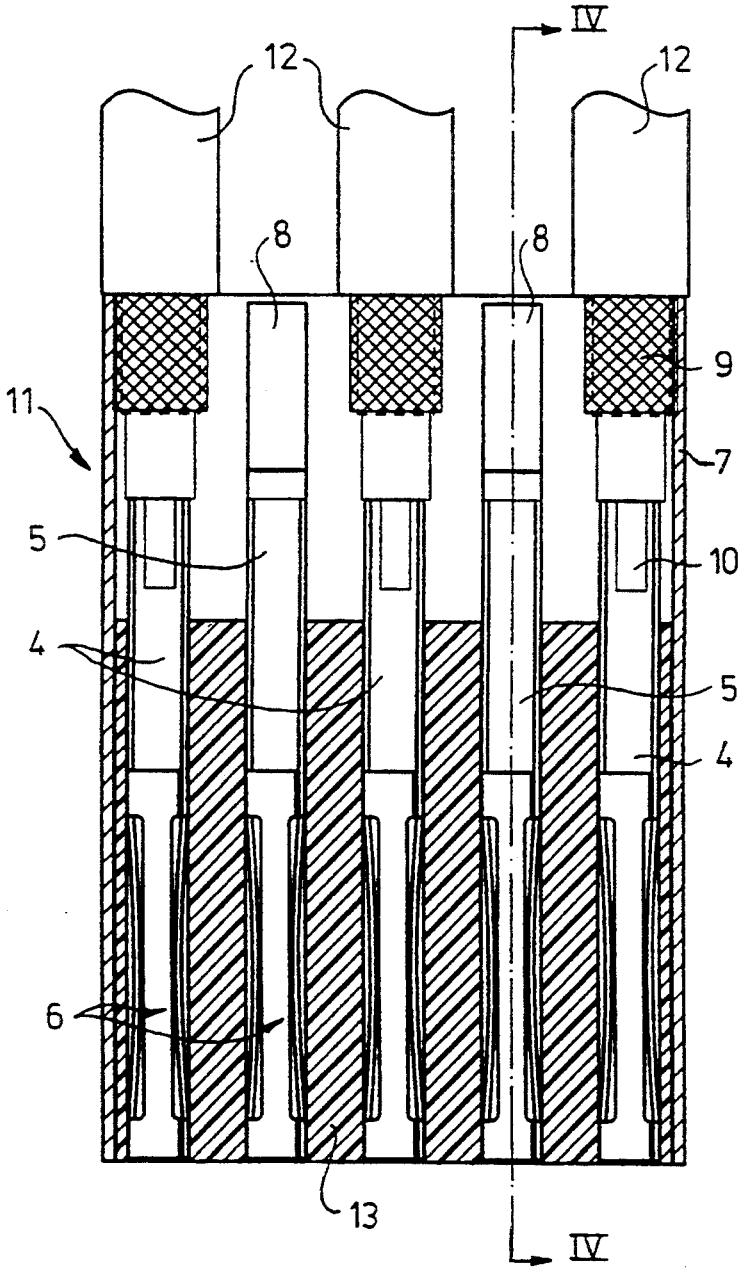
FIG. 3 is a longitudinal section of a second embodiment of the connector according to the invention for three coaxial cables.
Figure 4:
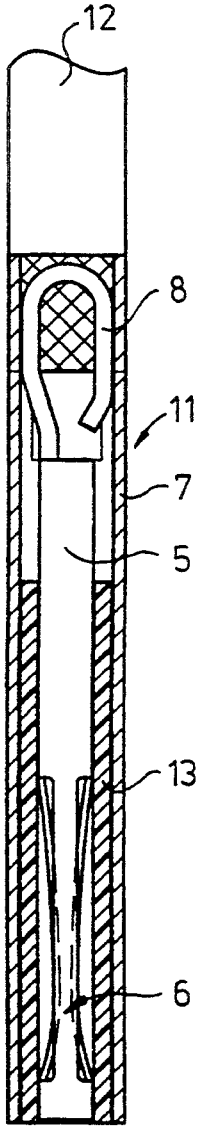
FIG. 4 is a section according to the line IV—IV in FIG. 3.

FIGS. 3 and 4 show a connector 11 mainly made in the same manner as the connector 1 of FIGS. 1 and 2. The connector 11 is adapted to connect three coaxial cables 12 to signal and ground contact pins on a printed circuit board. The connector 11 comprises a housing 13 of insulating material in which in this case three signal contacts 4 and two ground contacts 5 are mounted. The signal conductors of the cables are separated from each other within the connector 11 by ground contacts 5 also in this case. For the remaining part the connector 11 is made in the same manner as the connector 1.

Although in the described embodiments the ground contacts 5 are provided with a contact spring 8 at the end opposite of the contact part 6, it is also possible to provide a connection between a ground contact 5 and the inner side of the outer conductor 7 at the contact part 6.

It is further possible to combine a plurality of the described connectors 1 and/or 11 into a connector assembly.

The invention is not restricted to the above described embodiments which can be varied in a number of ways within the scope of the claims.

What is claimed is:

1. Connector for coaxial and/or twinaxial cables for connecting the cables to regularly arranged signal contact pins and ground contact pins, comprising a housing of insulating material and female signal contacts and female ground contacts regularly arranged in the housing and an outer conductor enclosing at least one of the female signal contacts, wherein the female signal contacts and female ground contacts are provided with identical parts to be plugged on said signal contact pins and ground contact pins, respectively, the outer conductor enclosing at least one of the female signal contacts and at least one of the female ground contacts, said at least one female ground contact being connected with the inner side of the outer conductor.

2. Connector according to claim 1 wherein each female ground contact comprises a spring element to be connected with the inner side of the outer conductor.

3. Connector according to claim 1, wherein the female signal contacts and female ground contacts are aligned within the outer conductor.

4. Connector according to claim 3, wherein the female signal contacts are separated in pairs within the outer conductor by an intermediate female ground contact.

5. Connector according to claim 3, wherein the female signal contacts are separated within the outer conductor by an intermediate ground contact.

6. Connector according to claim 1, wherein two or more coaxial or twinaxial cables are connected to the female signal contacts and female ground contacts of a connector, wherein the outer conductors of the cables are connected with the outer conductor of the connector.

7. Connector assembly, comprising a plurality of united connectors according to claim 1.

* * * * *